US006845766B2

(12) United States Patent
Pozzi et al.

(10) Patent No.: US 6,845,766 B2
(45) Date of Patent: Jan. 25, 2005

(54) CUTTING BLOCK FOR A SAWING MACHINE FOR SAWING STONE BLOCKS

(75) Inventors: Alessandro Pozzi, Mariano Comense (IT); Emilio Brusadelli, Valmadrera (IT)

(73) Assignee: Calvasina S.p.A. (IT)

( * ) Notice: Subject to any disclaimer, the term of this patent is extended or adjusted under 35 U.S.C. 154(b) by 343 days.

(21) Appl. No.: 10/010,178

(22) Filed: Nov. 13, 2001

(65) Prior Publication Data

US 2002/0078941 A1 Jun. 27, 2002

Related U.S. Application Data

(63) Continuation of application No. PCT/IT00/00186, filed on May 12, 2000.

(30) Foreign Application Priority Data

May 13, 1999 (IT) ..... MI99A001050
Aug. 3, 1999 (IT) ..... MI99A001736

(51) Int. Cl.[7] ..... B28D 1/00; B28D 1/06

(52) U.S. Cl. ..... 125/1; 451/12; 451/16.01; 451/16.03

(58) Field of Search ..... 83/751, 781; 125/12, 125/16.01, 16.03, 16.04, 17, 19

(56) References Cited

U.S. PATENT DOCUMENTS 397,244 A * 2/1889 Meyer ..... 125/17
1,563,256 A 11/1925 Crane
2,522,999 A * 9/1950 Dohlstrom ..... 125/19
2,554,678 A 5/1951 Minkler et al.
3,362,392 A * 1/1968 Miller ..... 125/17
3,678,918 A * 7/1972 Stauffer ..... 125/16.01
3,889,699 A * 6/1975 Ranieri ..... 125/16.01
4,092,971 A * 6/1978 Viscount ..... 125/16.01
4,612,214 A 9/1986 Salvi
5,398,458 A * 3/1995 Henriksen et al. ..... 451/41

FOREIGN PATENT DOCUMENTS

| | | |
|---|---|---|
| DE | 27049 | 5/1883 |
| DE | 2643490 | 4/1977 |
| DE | 86016334 | 11/1988 |
| WO | 9109733 | 7/1991 |
| WO | 9425237 | 11/1994 |

OTHER PUBLICATIONS

International Search Report dated Apr. 9, 2001 for Intl. Application No. PCT/IT00/00186.

* cited by examiner

*Primary Examiner*—Timothy V. Eley
(74) *Attorney, Agent, or Firm*—Ostrolenk, Faber, Gerb & Soffen, LLP

(57) ABSTRACT

The present invention relates to a cutting block for a sawing machine for sawing stone blocks into slabs which has a pair of opposed yokes for tensioning a plurality of blades by means of tie-bars with spurs, wherein the tie-bars which hold the blades have a single spur between two blades placed side by side.

17 Claims, 5 Drawing Sheets

110
46
62
106
108
44
102
104
80
66
63
64
65
70
60
68
90
88
47
56

CUTTING BLOCK FOR A SAWING MACHINE FOR SAWING STONE BLOCKS

CROSS REFERENCE TO RELATED APPLICATIONS

This is a continuation of PCT/IT00/00186 filed on May 12, 2000 and based, in turn, on Italian Applications MI99A001050 filed May 13, 1999 and MI99A001736 filed Aug. 3, 1999.

FIELD OF THE INVENTION

The present invention relates to a cutting block for a sawing machine for sawing stone blocks.

BACKGROUND OF THE INVENTION

Marble and similar stones e.g., the stones which can be worked like marble, such as, for example, granite and semi-marble limestone exhibit characteristics of workability, stability, durability and coloring such as to render these types of stone to be particularly suitable for use in the building industry. Moreover, because these stones can be readily smoothed and polished, they can be used as an outstanding decorative stone.

Blocks of marble and of similar materials are commonly cut into slabs which are subjected successively to various treatments such as smoothing and polishing. Once treated, such slabs can be reduced to the desired dimensions and the thickness thereof is somewhat reduced.

There is a strong need to provide slabs of marble or of similar materials having a thickness which is somewhat reduced, for example slabs of marble or of similar materials having a thickness of 5 mm.

The known cutting blocks for sawing machines for sawing stone blocks, such as the cutting blocks according to U.S. Pat. No. 1,563,256, do not allow one to obtain slabs of marble having a reduced thickness, that is less than 10 mm, due to the size of the forks supporting the blades. Furthermore, the known cutting blocks according to U.S. Pat. No. 2,554,678 are not warp-preventing guide for the blades placed beside it and have such a distance between the tie-bars that it causes the accumulation of the abrasive mixture necessary for sawing, as well as dirt on the cutting block.

The problem underlying the present invention is that of providing a cutting block for a sawing machine for sawing stone blocks which have structural and functional characteristics to satisfy the aforesaid strong need to obtain slabs of marble or of similar materials having a thickness which is somewhat reduced, and at the same time to avoid the drawbacks exhibited by the cutting blocks of the prior art.

SUMMARY OF THE INVENTION

This problem is solved by a cutting block for a sawing machine for sawing stone blocks into slabs and comprising a pair of opposed yokes for tensioning a plurality of blades by means of tie-bars with spurs, wherein the tie-bars, which hold the blades, have a single spur between two blades placed side by side.

BRIEF DESCRIPTION OF THE DRAWING(S)

Further characteristics and advantages of the cutting block for a sawing machine according to the invention will become clear from the description of preferred embodiments thereof, given by way of non-limiting examples, with reference to the following drawings, in which.

DETAILED DESCRIPTION OF EMBODIMENTS OF THE INVENTION

Figure 3:
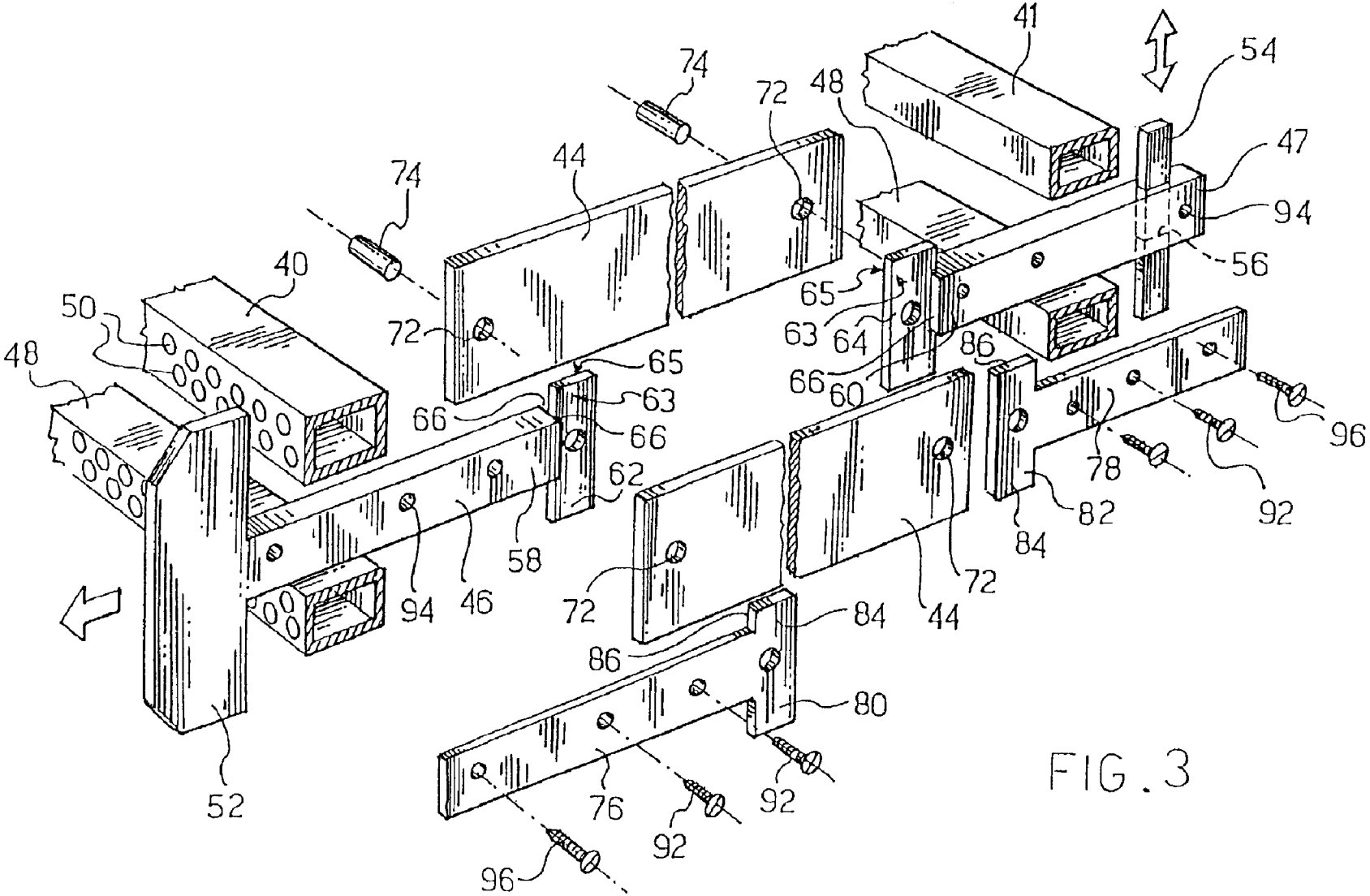
FIG. 3 is an exploded axonometric view of a detail of the cutting block of FIG. 1.
Figure 7:
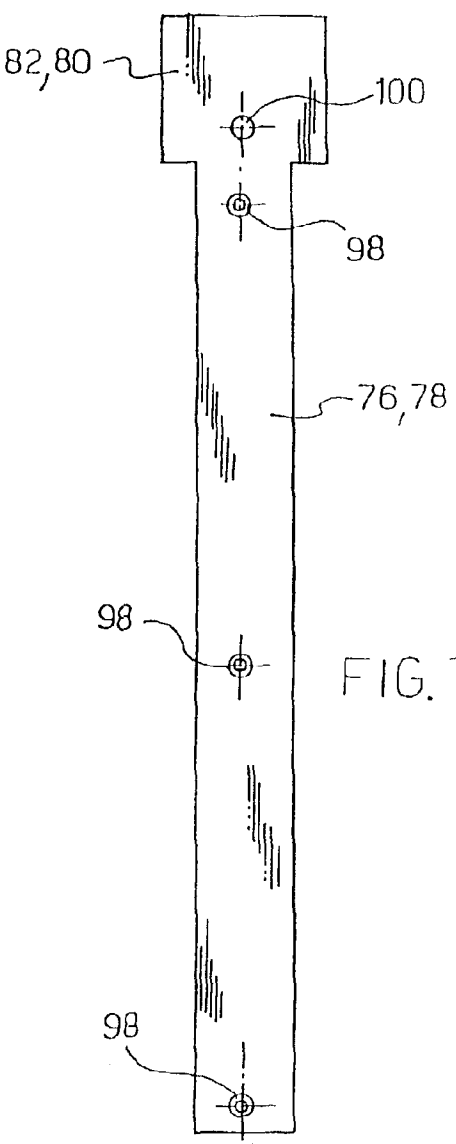
FIG. 7 is a side view of a fourth detail of a cutting block.
Figure 6:
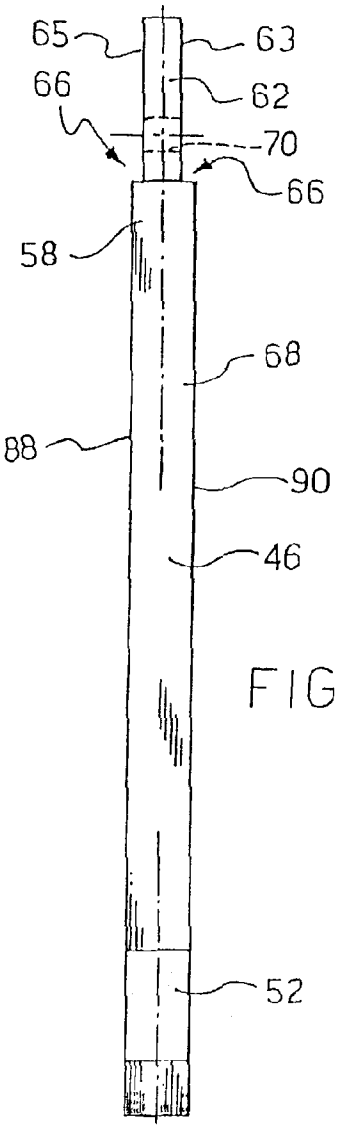
FIG. 6 is a top view of the detail of FIG. 5.

With reference to the aforesaid drawings, the reference 20 indicates as a whole a sawing machine or a sawing frame. The sawing frame 20 comprises a portal structure 22 within which pendulums 24 can move vertically in a controlled manner (along an axis Y or feed axis). A pivoting end of the pendulums 24 is connected to a sawing unit or cutting block 26. The cutting block 26 is connected to an actuating device, comprising a connecting rod 28 and a crank 30 which is connected operationally to a reduction motor 32. The actuating device makes it possible to impart to the cutting block 26 a reciprocating or sawing motion (along an axis X or working axis). The cutting block 26 is arranged horizontally for sawing an underlying stone block 34 into slabs according to a sawing technique which is known per se (FIG. 3).

Figure 1:
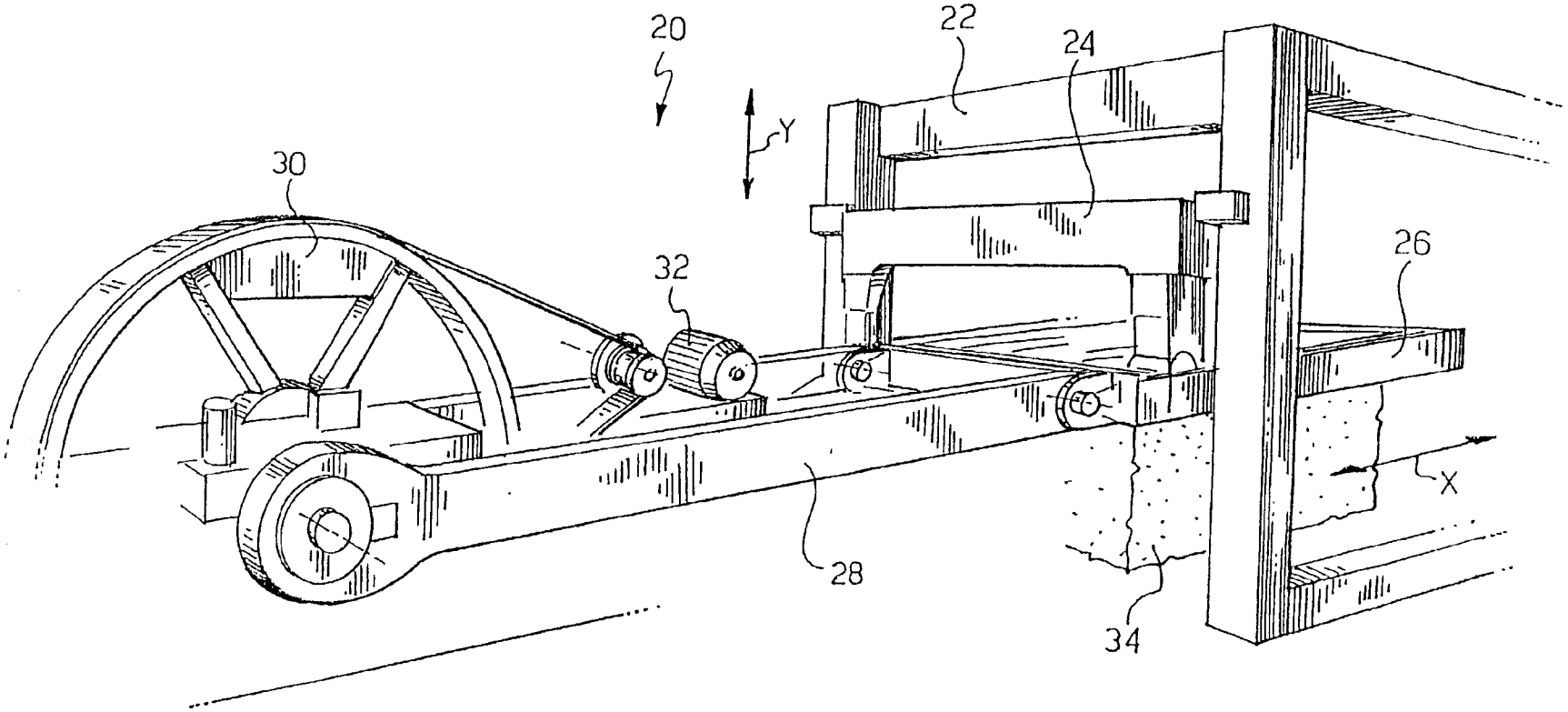
FIG. 1 shows in perspective, partially in section, a sawing frame.
Figure 2:
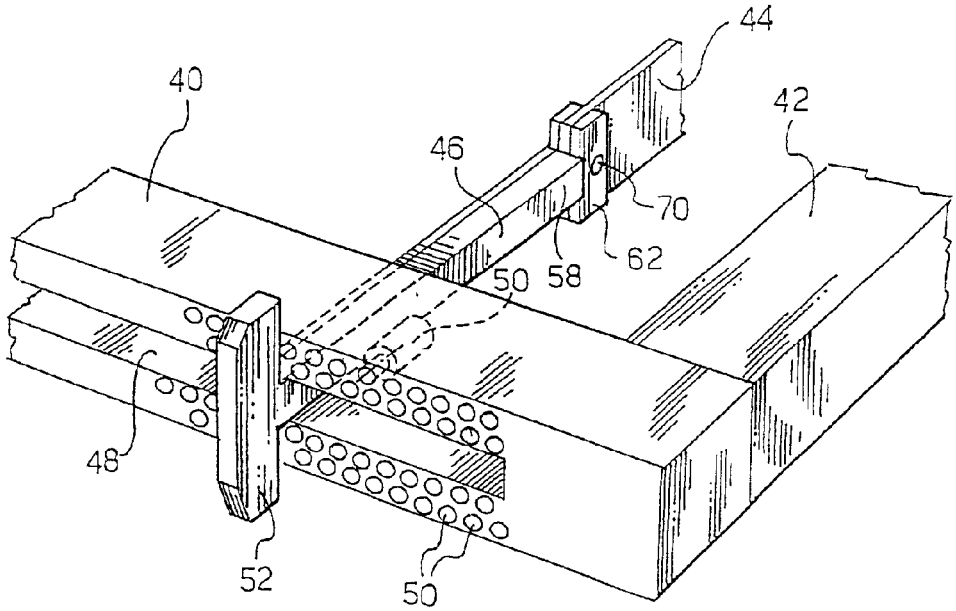
FIG. 2 is a perspective view of a detail of a cutting block.
Figure 4:
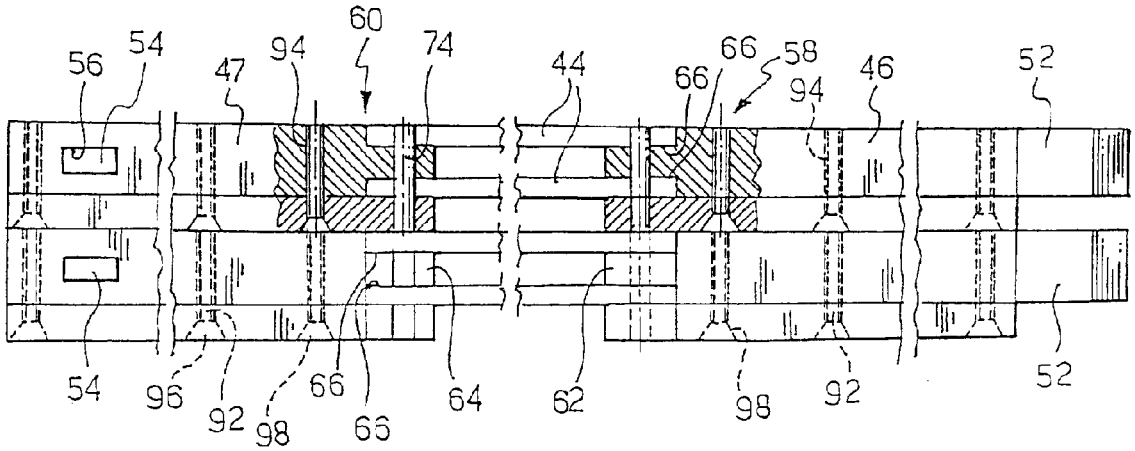
FIG. 4 is a partially sectional top view of a second detail of a cutting block.
Figure 5:
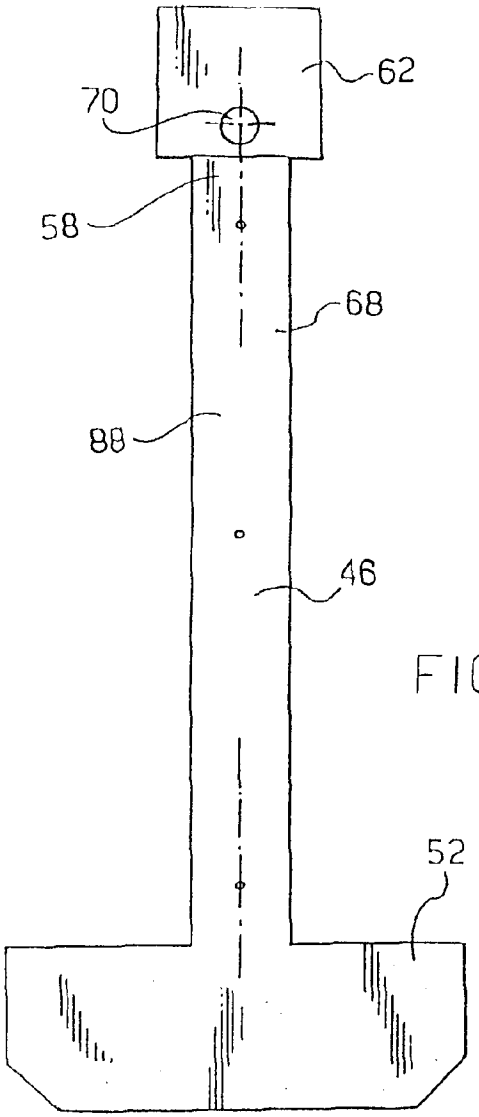
FIG. 5 is a side view of a third detail of a cutting block.

The cutting block 26 comprises opposed tension frames or yokes 40 and 41, connected to each other by struts 42 so as to form a framework. In the aperture delimited by the framework, there is a plurality of blades 44. The blades 44 are arranged parallel to one another and are placed under tension by means of tie-bars 46 and 47 co-operating with the yokes 40 and 41. In particular, in the yokes 40 and 41 there are longitudinal slots 48. In a first yoke 40 there is provided laterally to the slot 48 a plurality of piston and cylinder devices 50 actuated hydraulically. The cylinder and piston devices 50 emerge from the yoke 40 outside the framework, constituting a thrust surface or bed. A first tie-bar, or movable tie-bar 46, is received transversely in the slot 48 of the yoke 40 and provided with the thrust bed so as to bear on the thrust bed with one end, widened into a T-shaped head 52, so as to be drawn out from the framework. In the slot 48 of the opposed yoke 41 a second tie-bar, or fixed tie-bar 47, is received transversely so as to bear with an insert, or chock 54, received in a seating 56 transverse thereto, against the outer surface of the opposed yoke 41. The ends 58 and 60, within the framework, of the movable tie-bar 46 and fixed tie-bar 47 co-operate with the ends of blades 44 placed side by side with one another, in the manner which will be described in detail hereinafter (FIGS. 4 and 5).

The coupling ends 58 and 60 of the tie-bars 46 and 47 advantageously have a single connecting arm, or spur 62, 64, between two blades 44 placed beside each other. The spur 62, 64 has opposed lateral surfaces 63 and 65 for the support of the two blades 44 placed side by side. The surfaces 63 and 65 are arranged at a predetermined distance (FIGS. 6 to 12).

In a first embodiment of the invention, each tie-bar 46, 47 has on its sides of the ends 58 and 60 two channels with an L-shaped profile for coupling with the blades 44, arranged opposite each other and constituting lame bearing or incomplete seats 66. In other words, these incomplete seats are open seats, or in yet other words, the single seat 66 has half-bearing coupling surfaces. Said seats 66 are opposite one another and receive the ends of blades 44 placed beside each other.

In this first embodiment of the invention, the bar 68 of the tie-bar 46 and 47 has a thickness sufficient for placing under tension two blades 44 placed side by side and capable of withstanding the sawing action.

Each spur 62 and 64 is provided with a transverse through hole 70 that can be aligned with a corresponding through hole 72 provided at the coupling end of the blade 44. These holes 70 and 72 receive a connecting pin 74.

Advantageously, the tie-bars 46 and 47 co-operate with plate-like reinforcing members 76 and 78 placed alongside. In other words, beside each movable tie-bar 46 there is a movable reinforcing member 76 and, respectively, beside each fixed tie-bar 47 is provided a fixed reinforcing member 78. The reinforcing members 76 and 78 are equipped with a spur 80 and 82. Each spur 80 and 82 has respective opposed lateral surfaces 84 and 86 for the support of the blades 44 placed beside it. These surfaces 84 and 86 are arranged at a predetermined distance corresponding, for example, to the distance between surface 63 and its opposed surface 65 of the spur 62 and 64 of the tie-bar 46 and 47. In yet other words, the spurs 62, 64, 80 and 82 have the same transverse thickness. Lateral surfaces 84 and 86 co-operate with the lateral surfaces 63 and 65 of the spur of the tie-bar alongside, so as to surround the end of the blade 44 laterally. In this manner, the plate-like reinforcing members 76 and 78 close the incomplete seats 66 of the tie-bars 46, 47.

The lateral surface 84, 86 of the spur 80, 82 provided at the end of the reinforcing member 76, 78 constitutes an abutment for the pin 74 for connection of the tie-bar 46 and 47 to the blades 44. In a different embodiment of the invention, the spur 80, 82 of the reinforcing member 76 and 78 has a through hole 100 arranged coaxially with the through hole 70 of the co-operating tie-bar 46 and 47. The through hole 100 has a diameter smaller than the diameter of the hole 70 of the tie-bar 46, 47.

The reinforcing members 76 and 78 are coupled by pressure to one of the flanks 88 and 90 of the tie-bars 46 and 47. For example, these reinforcing members 76 and 78 are connected to the flank 88 and 90 of the tie-bars 46 and 47 by threaded means 92 screwed into threaded holes 94 provided in the bar 68 of the tie-bars 46 and 47. The heads of the threaded means 92, 96 are advantageously countersunk in seats 98 in the reinforcing members 76 and 78. Preferably, the heads of the threaded means 92, 96 and the seats 98 are conical, and the seats 98 receive heads of threaded means 92, 96.

To further advantage, each spur 62, 64, 80 and 82 extends from the bar 68 of the tie-bar 46 and 47, as well as of the reinforcing member 76, 78 in the manner of a hammer-head, or in other words of a T-shaped head. For example, the height of the hammer-head corresponds to the height of the blade 44. Each spur 62, 64 and 80, 82 with hammer-head constitutes a warp-preventing guide for the blades 44 placed side by side.

The operation of the cutting block for a machine for sawing stone blocks into slabs is described below.

With the machine 20 arranged for sawing a new stone block 34, the fixed tie-bar 47 and movable tie-bar 46 are inserted into the slots 48 of the opposed yokes 40, 41 of the cutting block 26. The tie-bars 46, 47 are previously coupled to the respective plate-like reinforcing members 76, 78. Then, to each pair consisting of a fixed tie-bar 47 and movable tie-bar 46 there is connected the end of two blades 44 placed side by side. This operation is particularly simple. In fact, the coupling end of each blade 44 is inserted into the seat 66 formed between the spur 62, 64 of the tie-bar 46, 47 and the spur 80, 82 of the reinforcing member 76, 78 or, in other words, in the seats 66 provided laterally of the spur 62, 64 of the tie-bar 46, 47. The blades 44 placed side by side are connected to the spur 62, 64 of the tie-bar 46, 47 by the insertion of the pin 74 into the through hole 70 of the tie-bar 46, 47. The pin 74 is pushed as far as it will go against the lateral surface 86 of the spur 80, 82 of the reinforcing member 76, 78 at the through hole 100. In the case where it is wished to proceed with the sawing of a stone block 34 into thin slabs, it is therefore sufficient to bring the lateral surface of a tie-bar 46, 47 alongside the opposed lateral surface of the reinforcing member 76, 78 of the neighbouring tie-bar 46, 47. In this way, the incomplete seat 66, opposite the reinforcing member 76, 78 of each tie-bar 46, 47 is closed by the outer lateral surface 84 of the reinforcing member 76, 78 of the tie-bar 46, 47 alongside. Furthermore, by bringing a reinforcing member 76, 78 alongside the tie-bar 46, 47, the connecting pin 74 is blocked in the working position.

With the blades 44 connected to the movable tie-bars 46 and fixed tie-bars 47, by means of the thrust bed 50 a drawing-out action is exerted on the movable tie-bars 46, placing the blades 44 under tension. When the operation of placing the blades 44 under tension is completed it is possible to proceed with the sawing of the stone block 34.

From the above it can be understood that the proposed cutting block for a sawing frame for sawing stone blocks into slabs makes it possible to obtain the sawing of thin slabs. In fact, the minimum distance obtainable between two opposed blades is equal to the thickness of a single spur. Therefore it will be possible to reduce the distance between two opposed blades to the minimum thickness with which it is possible to construct a spur capable of withstanding the stress necessary for placing the blade under tension and the stress corresponding to the sawing action.

A further advantage of the invention lies in the fact that the structure proposed for the cutting block is particularly simple. Moreover, the proposed cutting block is easy to arrange for sawing.

The side by side arrangement of the tie-bars avoids the accumulation of the abrasive mixture necessary for sawing, as well as dirt on the cutting block.

A further advantage of the invention is due to the fact that by providing a spur of predefined thickness, or having a predefined distance between the lateral bearing surfaces for opposed blades, it is possible to avoid any further device for regulating the distance between the blades, such as the known special spacers. In other words, the spur of the cutting block of the invention, besides constituting a connecting element between the tie-bar and the blade, constitutes a spacing member between two opposed blades.

Moreover, the spur performs a fundamental function of warp-preventing guide for the blades placed beside it. This function is particularly important during the sawing operation, and in particular during the attack of the blade on the irregular upper surface of the stone block.

It is clear that variants and/or additions to what is described and illustrated above may be provided.

Figures 8, 9, 10, 11, 12, 13:
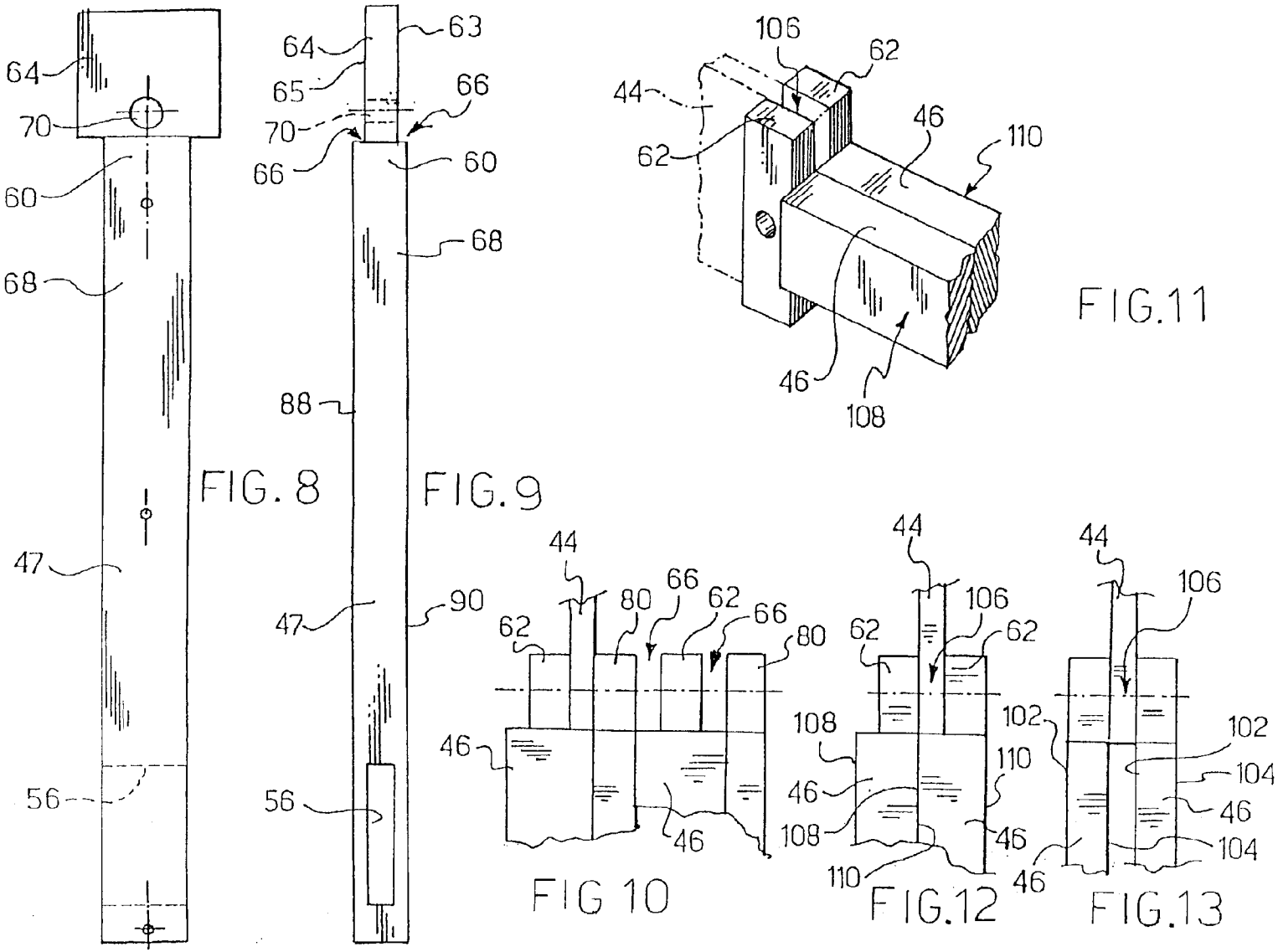
FIG. 8 is a side view of a fifth detail of a cutting block.
FIG. 9 is a top view of the detail shown in FIG. 8.
FIG. 10 is a top view of a detail of the detail of FIG. 4.
FIG. 11 is a perspective view of a detail of a second embodiment of the invention.
FIG. 12 is a top view of the detail of FIG. 11.
FIG. 13 is a top view of a detail of a third embodiment of the invention.

In a different embodiment of the invention, a flank 102 of the end of each of the movable tie-bars 46 and fixed tie-bars 47 co-operates with the opposed flank 104 of the tie-bar 46,47 alongside, surrounding the end of the blades 44. In other words, seats are not provided in the tie-bars 46, 47 for the blades 44 (FIG. 13).

In a further embodiment of the invention, each tie-bar 46,47 has a channel with an L-shaped profile at one end for connection to the blade 44. The channel with an L-shaped profile constitutes an incomplete attachment seat 106 for the blade 44. In this embodiment, the lateral surface 108 of the tie-bar 46, 47 is brought alongside a lateral surface 110 of the contiguous tie-bar 46,47 and said tie-bars 46,47 are arranged with flanks 108, 110 in mutual contact (FIGS. 11 and 12).

As can be understood from what is described above, the cutting block for a sawing machine for sawing stone blocks according to the invention makes it possible to satisfy the requirements referred to in the introductory part of the present description, and at the same time to remedy the drawbacks exhibited by the cutting blocks of the prior art.

Obviously, a person skilled in the art, for the purpose of satisfying contingent and specific requirements, may apply numerous modifications and variants to the cutting block which is described above, all however included within the scope of the invention as defined by the following claims.

What is claimed is:

1. A cutting block for a sawing machine for sawing stone blocks into slabs, comprising a pair of opposed yokes for tensioning a plurality of blades by means of tie-bars with spurs, said tie-bars which hold said blades each have a single spur between two substantially parallel blades;

each said spur constitutes a spacing straightedge for said two blades; and wherein each said spur has lateral surfaces for support of said two blades placed side by side, arranged at a predetermined distance.

2. A cutting block, according to claim 1, wherein each said tie-bar comprises a bar and each said spur extends from said bar to form a hammer-head shape.

3. A cutting block, according to claim 2, wherein said spur constitutes a warp-preventing guide for said blades.

4. A cutting block, according to claim 1, wherein each said spur is provided with a through hole to be aligned with a corresponding blade through hole for receiving a connecting pin.

5. A cutting block, according to claim 4, wherein said spur has a lateral surface provided at one end of said plate-like reinforcing member and operative as an abutment for said connecting pin.

6. A cutting block for a sawing machine for sawing stone blocks into slabs, comprising a pair of opposed yokes for tensioning a plurality of blades by means of tie-bars with spurs, said tie-bars which hold said blades each have a single spur between two substantially parallel blades; and each of said tie-bars includes a respective flank having two L-shaped channels at one end of each said respective flank for coupling to each of said blades and constituting incomplete seats for said blades.

7. A cutting block, according to claim 6, wherein said tie-bars co-operate with plate-like reinforcing members, and each said plate-like reinforcing member is provided with a spur.

8. A cutting block, according to claim 7, wherein said reinforcing members are coupled by pressure to the flanks.

9. A cutting block, according to claim 8, wherein said reinforcing members are connected to said flanks by threaded means screwed into threaded holes provided in the tie-bars.

10. A cutting block, according to claim 7, wherein each said spur provided with each said plate-like reinforcing member has a spur through hole corresponding with a respective tie-bar through hole, wherein said spur through hole has a diameter smaller than the diameter of said respective tie-bar through hole.

11. A cutting block, according to claim 6, wherein each respective flank co-operate with an opposed respective flank of a substantially parallel tie-bar to provide attachment seats for said blades.

12. A cutting block for a sawing machine for sawing stone blocks into slabs, comprising a pair of opposed yokes for tensioning a plurality of blades by means of tie-bars with spurs, wherein said tie-bars which hold said blades each have a single spur between two substantially parallel blades;

each said spur constitutes a spacing straightedge for said two blades;

said tie-bars co-operate with plate-like reinforcing members, and each said plate-like reinforcing member is provided with a spur, said reinforcing members are coupled by pressure to the flanks, said reinforcing members are connected to said flanks by threaded means screwed into threaded holes provided in the tie-bars, and said threaded means each have a head adapted to be countersunk in seats provided in said reinforcing members.

13. A cutting block, according to claim 12, wherein said seats are conical and receive conical heads of screws.

14. A cutting block for a sawing machine for sawing stone blocks into slabs, comprising a pair of opposed yokes for tensioning a plurality of blades by means of tie-bars with spurs, wherein said tie-bars which hold said blades each have a single spur between two substantially parallel blades, wherein said tie-bars are arranged with flanks in mutual contact.

15. A cutting block, according to claim 14, wherein each said tie-bars has an L-shaped channel and constituting an incomplete attachment seat for said blades.

16. A cutting block for a sawing machine for sawing stone blocks, the cutting block comprising:

at least two opposing tie-bars operative to hold a plurality of blades extending between the tie-bars;

each tie-bar having an end, a respective spur coupled to the end of each tie bar, and each spur is positioned between two respective blades, each spur providing a straightedge space between the two blades, and each spur including lateral surfaces to support the blades; and a pair of opposed yokes coupled to the at least two opposing tie-bars and operative to adjust the tension of the plurality of substantially parallel blades.

17. A cutting block according to claim 16, further comprising a plurality of substantially parallel blades operative to saw the stone blocks and held by the tie-bars.

* * * * *